US006038708A

United States Patent [19]

Schreck

[11] Patent Number: 6,038,708

[45] Date of Patent: Mar. 21, 2000

[54] AUTOMATIC TOILET SEAT WITH PROTECTIVE COVERING

[75] Inventor: Roman Schreck, Antibes, France

[73] Assignee: Rosch Holding S.A., Geneva, Switzerland

[21] Appl. No.: 09/251,194

[22] Filed: Feb. 16, 1999

[30] Foreign Application Priority Data

Feb. 16, 1998 [DE] Germany ..... 198 06 007

[51] Int. Cl.[7] ..... A47K 13/14

[52] U.S. Cl. ..... 4/244.1

[58] Field of Search ..... 4/244.1, 244.2

[56] References Cited

U.S. PATENT DOCUMENTS 4,297,750 11/1981 Lutz ..... 4/244.2

FOREIGN PATENT DOCUMENTS 0 402 438 12/1992 European Pat. Off. .

90/06715 6/1990 WIPO .

*Primary Examiner*—Robert M. Fetsuga

*Attorney, Agent, or Firm*—St. Onge Steward Johnston & Reens LLC

[57] ABSTRACT

An automatic toilet seat having two electric drives functioning independently of one another is provided. One motor is connected to the seat and the other operates a paper gripper. Both motors are controlled by appropriate sensors and by an intelligent microprocessor control device. This particular technological model has the advantage that, due to the separate arrangement with one drive motor for the pivot drive of the seat and, independent of that, one drive motor for seizing the protective cover, it is possible to operate both drives completely separately from one another and thus to link the drives by an intelligent microprocessor control. With the intelligent microprocessor control unit, it is possible to adjust the two drives independently of one another and to adjust both of them to the site conditions (i.e., the location where the toilet seat is installed).

29 Claims, 6 Drawing Sheets

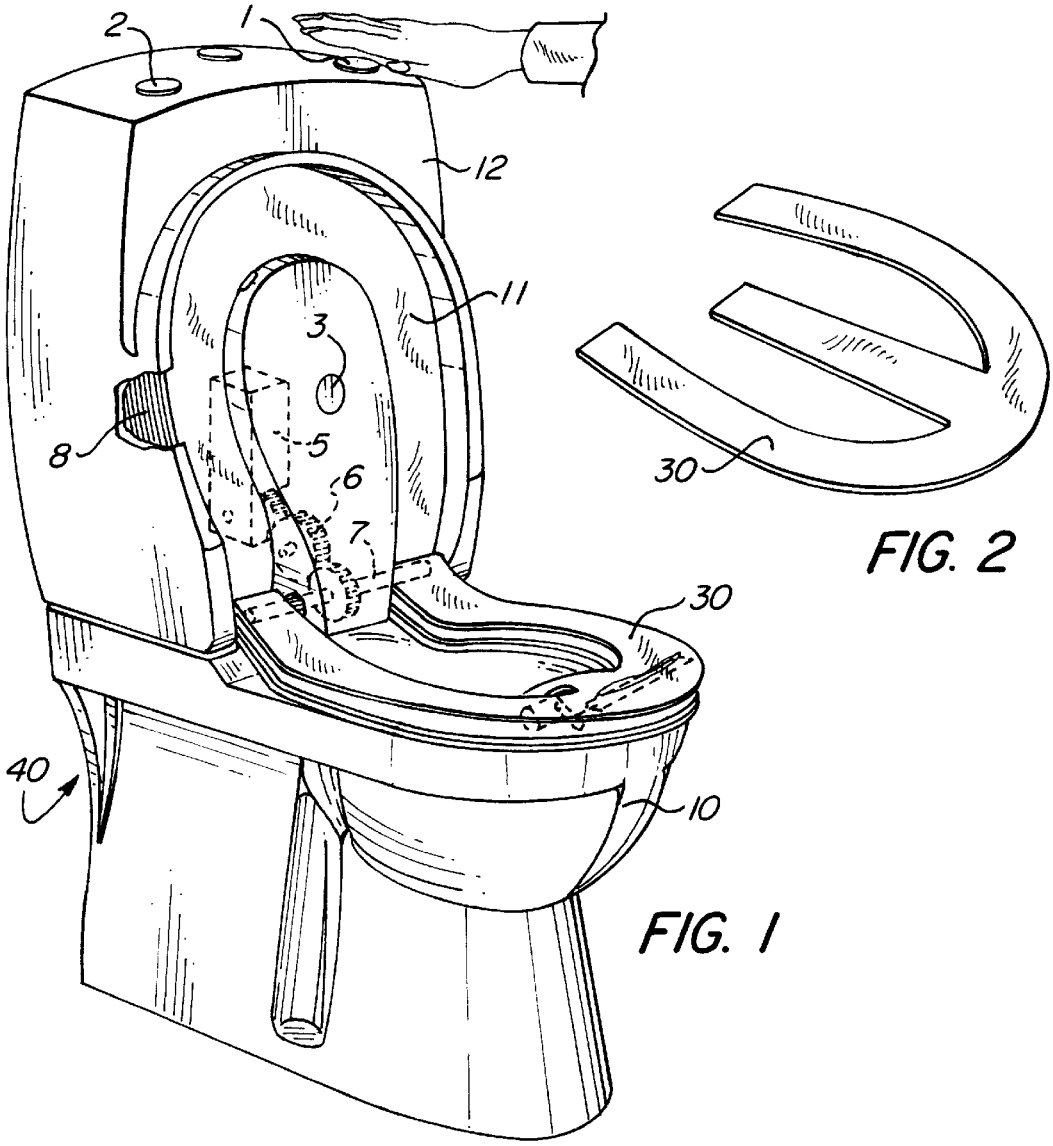
FIG. 2
FIG. 1
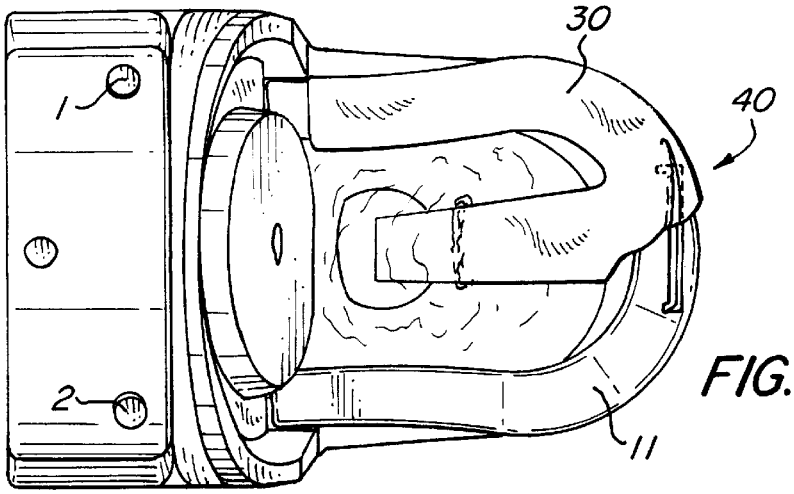
FIG. 3

AUTOMATIC TOILET SEAT WITH PROTECTIVE COVERING

FIELD OF THE INVENTION

The present invention relates to an automatic toilet seat with a protective covering, and more particularly to a drive mechanism for such an automatic toilet seat.

BACKGROUND OF THE INVENTION

Automatic toilet seats with protective coverings are well known, with such a toilet seat being disclosed in EP 402 438 B1. This prior art toilet includes a seat which can be automatically raised and lowered, and a paper gripper which is designed to remove a protective paper from a paper stack installed in a case and then cover the seat with this paper. The automatic toilet seat is controlled by a single drive motor, which operates both the pivot action of the seat and also the action of the paper gripper.

This single motor design, however, requires an extremely complex action involving cam plates which must operate with precise timing. A mechanism is provided which allows the single drive motor to power the paper gripper to extract one protective cover from the paper stack while at the same time the seat is pivoted upward. As soon as the paper is caught by the paper gripper, the drive motor continues running through the appropriately controlled cam plates and sets the pivot action of the seat in motion, so that the seat then pivots down into the ready position with the paper secured thereon. After use is completed, the process is reversed, so that first the paper gripper is released while the seat is in the lowered position permitting the protective covering to be removed from the seat during the ensuing flushing, and then once the paper gripper is released, the seat is pivoted upward into the raised position where it remains.

This is a very cumbersome drive operation and the related mechanism with its appropriate mechanical delayed timing sequence is extremely expensive to produce. As a further disadvantage, because this well-known installation uses a complicated mechanism, it is necessary to employ a gas pressure spring which ensures that, when the seat is pivoting downward, the resulting acceleration forces are caught and contained, in order to avoid having the seat strike the rim of the toilet bowl at high speed. Another disadvantage of this arrangement is that it is not necessarily controllable because a single drive motor is used. One result, for instance, is that the speed of the seat's pivoting motion cannot be adjusted nor can the time interval between the pivoting of the seat and the action of the paper motor or other similar items. In other words, such an arrangement, given the conditions of its construction, cannot be reduced or adjusted. Furthermore, owing to the absence of an intelligent control, there is the disadvantage that related additional mechanisms cannot be controlled, such as additional mechanisms for the infusion of a disinfectant during the flushing process.

What is desired therefore is a drive mechanism for an automatic toilet seat with a protective cover which can be produced and operated with substantially improved cost effectiveness, simplicity, and safety.

SUMMARY OF THE INVENTION

Accordingly, it is an object of the present invention to provide a drive mechanism for an automatic toilet seat with a protective cover which can be produced and operated with substantially improved cost effectiveness, simplicity, and safety.

These and other objects of the present invention are achieved by provision of an automatic toilet seat having two electric drives functioning mechanically independently of one another, one motor connected to the seat and the other operating the paper gripper. Both motors are controlled by appropriate sensors and by a programmed microprocessor control device. This particular technological model has the advantage that, due to the separate arrangement with one drive motor for the pivot drive of the seat and, mechanically independent of that, one drive motor for seizing the protective cover, it is possible to operate both drives completely separately from one another and thus to link the drives by a programmed microprocessor control. With the microprocessor control unit, it is possible to adjust the two drives independently of one another and to adjust both of them to the site conditions (i.e., the location where the toilet seat is installed).

In the preferable application of the present invention, it is expected that the microprocessor built into the control portion of the toilet seat can be programmed from outside by an appropriate personal computer or the like. Most preferably, programming can be accomplished by an infrared control part by means of which the related functions of the built-in microprocessor can be programmed wirelessly. In whatever form the invention is applied, it is important to note that the individual drive characteristics and timing can be programmed exactly with individualized adaptations, something not possible with the aforementioned toilet described in EP 402 438 B1. With that device, the pivot drive settings were fixed with its cam plates and its mechanism, so that any change in pivot characteristic, timing, or other parameters required a replacement or modification of the cam plates. The programming of the various characteristics of both the aforementioned drive motors also includes the possibility of programming the related sensors, in order to adjust the working range, for instance.

A particular advantage is gained if a DC motor is used for the pivot motor for the toilet seat pivoting action, since such a motor has very high torque at low revolutions per minute. This is helpful because it requires only slight reduction by a reduction gear to adjust the speed of the DC motor from 10 rpm, for instance, for the appropriate pivoting motion of the toilet seat. One further advantage in using a DC motor is that, in case of an accidental voltage reduction, the torque characteristics are not appreciably changed. If this kind of voltage drop should occur—in excess of the normal tolerance—it is prearranged that the DC motor reduces its revolutions per minute accordingly, leading to a very weak pivoting motion of the toilet seat if the operating voltage of the DC motor is reduced by a corresponding amount during the downward motion of the toilet seat. Consequently, the DC motor softens the downward pivot action, and there is no further need of a gas pressure spring for the reduction of such a pivoting action. Considerable savings in manufacturing costs can also result.

A similar advantage is found in the use of the paper motor for the gripping and clamping of a protective seat cover from a vertical paper stack. A relatively small geared motor is used here, such as those found in office machines, in which the gearbox is already flanged onto the motor and an appropriate reduction is provided. This motor can be produced at very reasonable cost, and the total construction of the automatic toilet seat becomes up to 50% less expensive than the production costs of a toilet seat using existing technology.

The automatically controlled operation of the toilet seat shall now be briefly described. After switching on, the control initializes the toilet and raises the seat. As soon as sensor 1 recognizes a hand, the seat moves back against the paper stack, then rotates a few millimeters forward to release the stack. The paper motor then grasps the paper and the seat sinks to the horizontal position. After an adjustable period (this interval only counts if sensor 3 does not recognize the presence of a person), or after sensor 2 recognizes a hand, the paper is released and flushing action is triggered (either by a motor or by a valve). The disinfection pump then runs for an adjustable period of time, the flushing is turned off, and then the seat is raised once again. If sensor 2 is activated without the seat being in the horizontal position, then the toilet is only flushed and disinfected. If sensor 3 recognizes a person's presence but the seat is not in the horizontal position, then the control assumes that someone is standing and urinating. If the person departs without flushing, then the control activates the flushing independently. Approximately 24 hours after the latest flushing, an automatic flush takes place in order to prevent drying up of the toilet.

The invention and its particular features and advantages will become more apparent from the following detailed description considered with reference to the accompanying drawings.

BRIEF DESCRIPTION OF THE DRAWINGS

FIG. 1 is an isometric view of the automatic toilet seat with a protective covering in accordance with the present invention;

FIG. 2 is a top view of the automatic toilet seat of FIG. 1;

FIG. 3 is a isometric view of the protective toilet seat covering for the automatic toilet seat of FIG. 1;

DETAILED DESCRIPTION OF THE INVENTION

Figure 5:
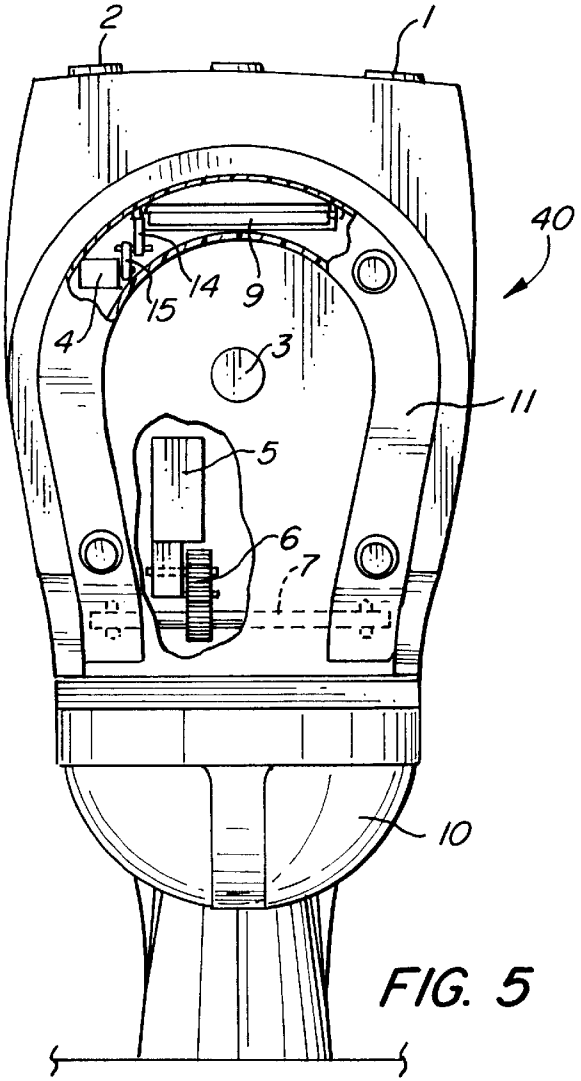
FIG. 5 is a front view of the automatic toilet seat of FIG. 1.
Figure 4:
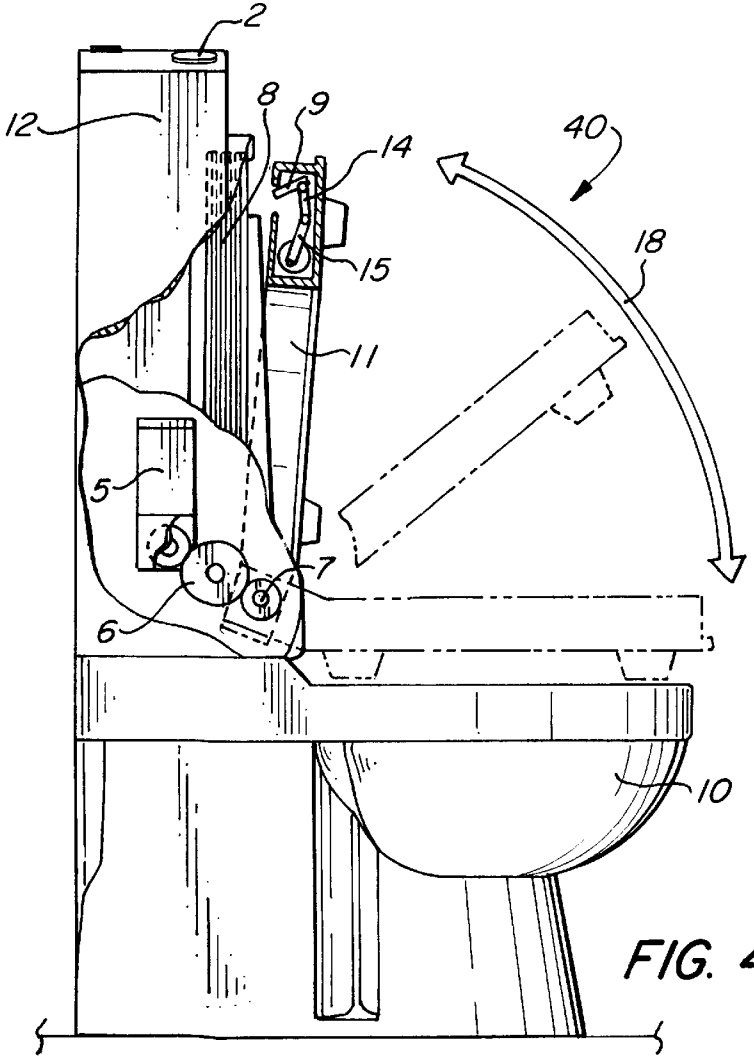
FIG. 4 is a side view of the automatic toilet seat of FIG. 1.
Figure 6A:
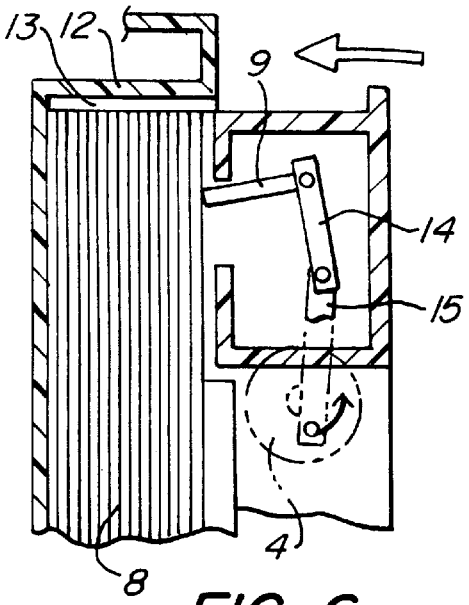
FIGS. 6*a*–6*c* are side views of the automatic toilet seat of FIG. 1 showing the operation of the gripping mechanism.
Figure 6B:
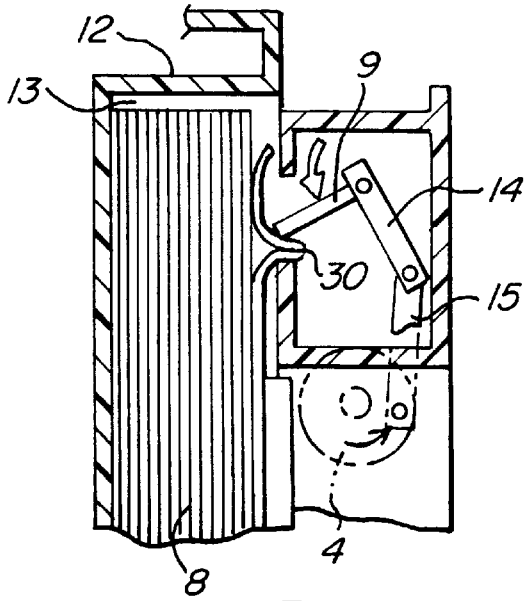
Figure 6C:
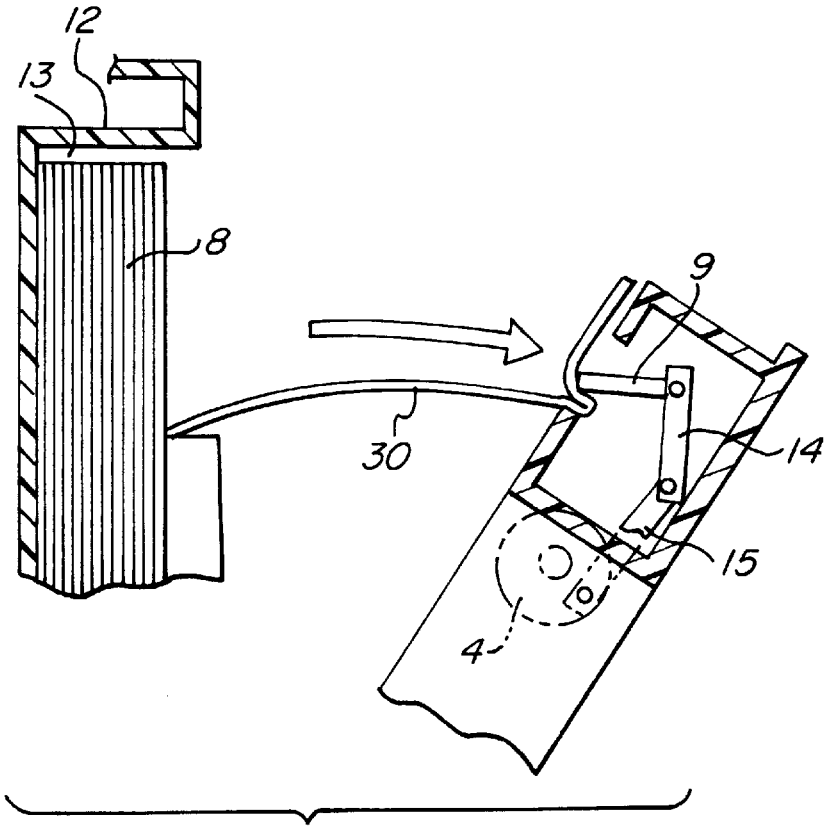

An automatic toilet seat (40) in accordance with the invention is shown in FIGS. 1 through 6. Referring first to FIGS. 1 through 6, a toilet seat (11) is connected with pivots to a toilet bowl (10) in a horizontal position that is not described in any further detail. Behind the toilet seat (11) a case (12) is installed in which space (13) is allotted for a paper stack (8). In this paper stack (8), the protective seat covers are arranged, aligned with one another and stacked. During each use, the front most protective toilet seat cover (30) is removed from the paper stack (8) by the grabber (9), to be described below, and is used to cover the surface of the toilet seat (11). The case (12) may be shaped like a flush tank in order to displace a corresponding amount of flushing water. This is, however, not essential to the operation, because the case (12) can also be dispensed with and replaced by a corresponding magnetic valve, so that the flushing water is fed directly into the toilet bowl by an appropriately activated magnetic valve.

In the upper portion of the case (12) the first sensor (1) is installed. This sensor (1) triggers the entire action of the automatic toilet seat (40). Thus, if a user approaches the toilet and activates sensor (1), the entire process is then set in motion, as is shown hereafter with reference to FIG. 9. Second sensor (2) is optional and not essential to meeting the objectives of the present invention. The second sensor (2) comes into play only if the user decides to make use of the toilet with the seat raised, such as in using it as a urinal (with raised toilet seat 11). In this case the activation of sensor (2) serves to trigger the flushing action without setting the pivot mechanism of the toilet seat or the gripping mechanism of the paper gripper in operation.

Whereas sensor (1) and sensor (2) are intended to function at relatively short distances without being touched, and can be activated for instance by the user's hand, third sensor (3), mounted on the front side (facing side) of the case (12), is intended to register the presence of a body even at a considerable distance. Thus, whereas both sensor (1) and sensor (2) must be activated intentionally, sensor (3) is intended to register the presence of a body. This has the advantage that if the user has sat on the seat and used the toilet in the normal manner, or has used the toilet as a urinal with the seat raised, then the toilet will flush automatically when the person leaves the sensor area, that is, when the person moves away from the toilet bowl (10). Therefore, if the user should forget to flush, sensor (3) is designed to ensure that flushing takes place automatically when the person leaves the toilet area.

The structure of the toilet, according to this invention, is described below in further detail. The toilet seat (11) on its lower pivot side has a drive shaft (7). The drive shaft (7) is engaged by a gear wheel of a gear wheel works (6) (best seen in FIGS. 1 and 4), which is driven by an installed pivot motor (5), built into the case (12). As previously mentioned, the pivot motor (5) will preferably take the form of a DC motor controlled by a microprocessor. At the upper, free, pivotable end of the seat, a paper gripping motor (4) is also installed, which guides a grabber (9) by means of a connected pivot rod (pivot lever 14 and eccentric lever 15), which grabber preferably on its front side has a friction-increased coating and can make a crease or fold on the topmost paper (30) of the paper stack (8), grasp this fold, and then secure the first creased and clamped sheet of paper and secure it to the surface of the toilet seat (11). It is also possible that a single motor having a transmission operates both the pivot lever (14) and the drive shaft (7). The microprocessor in this case would control the operation of the transmission.

When the toilet seat pivots downward in the direction of the arrow (18), the upper end of this protective cover is secured on the upper (front) side of the toilet seat (11) and the rest of this seat cover is automatically removed from the paper stack (8) and automatically covers the remaining surfaces of the toilet seat. In the process, the paper grasping mechanism works in such a way that the motor (4) works with a drive shaft (16) on the pivot rod of the levers (14, 15). Position 18 in FIG. 4 thus illustrates the course of motion of the front end of the toilet seat (11).

Figure 9:
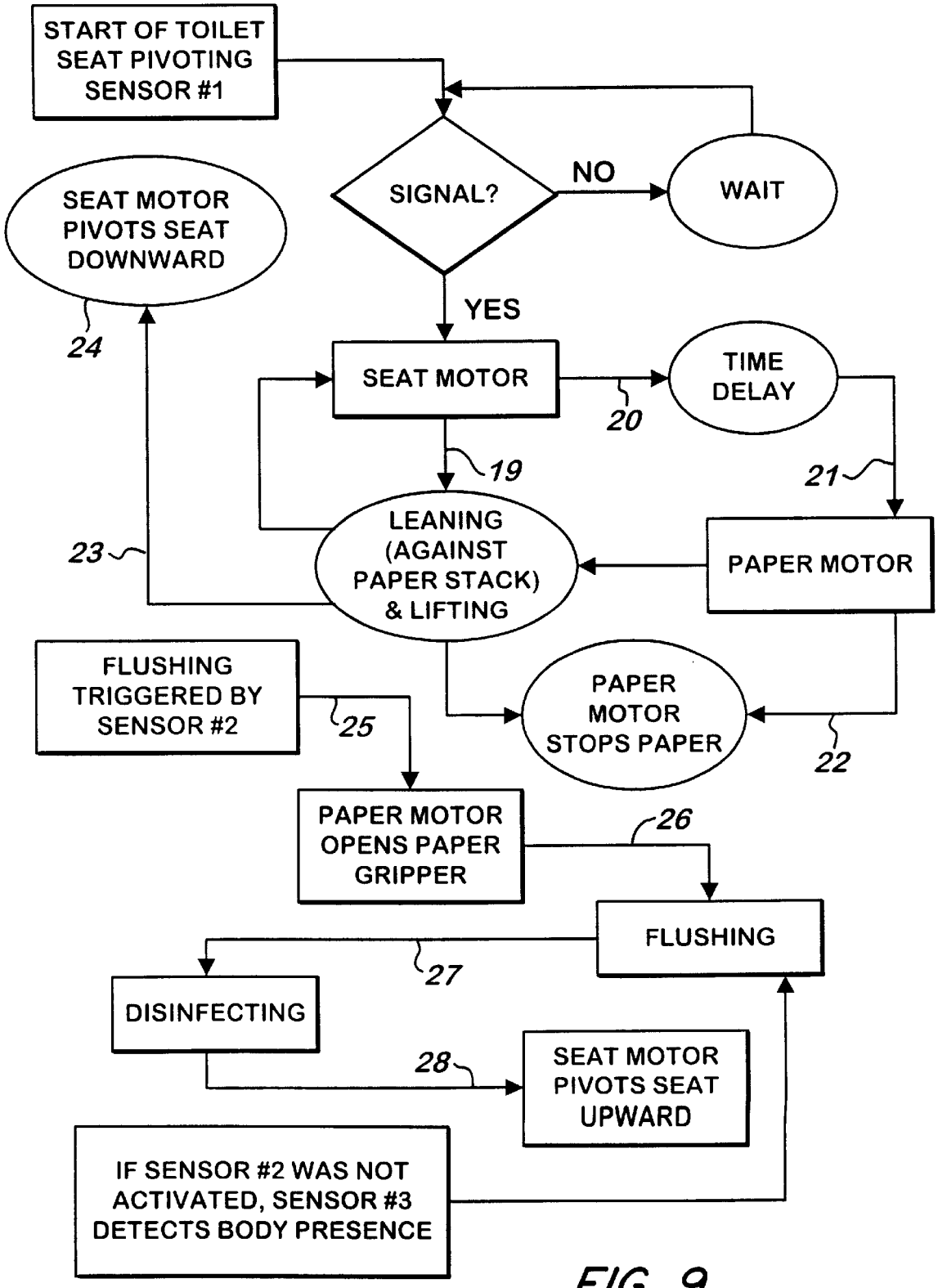
FIG. 9 is a flow diagram of the function of the automatic toilet seat of FIG. 1.

FIG. 9 presents the course of operation of the programmed control. Once the device is set in motion by the activation of sensor (1), this signal is conveyed onward to the pivot motor (5), which forces the toilet seat (11) in the counterclockwise motion of the arrow (17) against the paper stack (8) and compresses the paper stack. The grabber (9) is brought into spring-activated contact with the foremost paper sheet in the paper stack (8). After the toilet seat (11) is leaned against the paper stack (8), which is compacted thereafter by an additional minor pivoting motion of the seat (11), the seat (11) is lifted again slightly from the paper stack (8), but without losing the spring-activated contact. Thereafter the paper gripper motor (4) is set in motion, and activates the grabber (9) with its pivot rods (14, 15) and makes a crease in the foremost sheet of paper (30) of the paper stack (8) and grips this fold. The previously described leaning and lifting by the seat motor ensues at position (19) in FIG. 9. At position (20), then, a time delay is introduced, which then starts up the paper motor at position (21) with a time lag. The paper motor stops the paper at position (22) and holds it firmly. The pivot motor (5) then pivots downward at position (23), while the gripper motor (4) remains in its gripping position. Thus, at position (24) the toilet seat is in its downward pivoted position and is covered with the protective seat cover. The toilet can now be used as intended.

Upon completion of use of the toilet, the user activates sensor (2)—as demonstrated in position (25)—and sensor (2) controls the paper gripping motor (4), which opens the grabber (9) and then, with a time delay at position (26), sets the flushing in motion. With the flushing or after its completion, at position (27), a flushing agent can also be poured into the toilet bowl. This can occur, for instance, with guidance by an electromagnetic valve. Guidance can also be ensured by an appropriate pump motor, which siphons the disinfectant from an appropriate storage container and deposits it into the toilet bowl. Once flushing is completed at position (26), and after disinfection, if applicable, at position (27), the pivot motor (5) is set in motion at position (28), which pivot motor (5) pivots the seat (11) back upward, in counterclockwise motion in the direction of the arrow (17), into its original position.

An additional sensor (3) is provided, which—as described above—triggers an automatic process if the user has forgotten to activate sensor (2) on completing the use of the toilet. The disinfectant is preferably introduced shortly before completion of flushing to ensure that the disinfectant remains in the toilet bowl after flushing is complete. Most preferably, the quantity of flushing fluid can also be modified. The pivot motor (5) is set in motion after the completion of flushing. It can be seen in FIG. 1 that sensor (1) triggers the pivot motor (5), which consequently pivots the toilet seat to the upright position. The toilet seat is pivoted somewhat more strongly backward in the direction leaning against the paper stack and then is lifted. The paper gripping motor (4) then goes into action and grips the front most sheet of paper.

Figure 10:
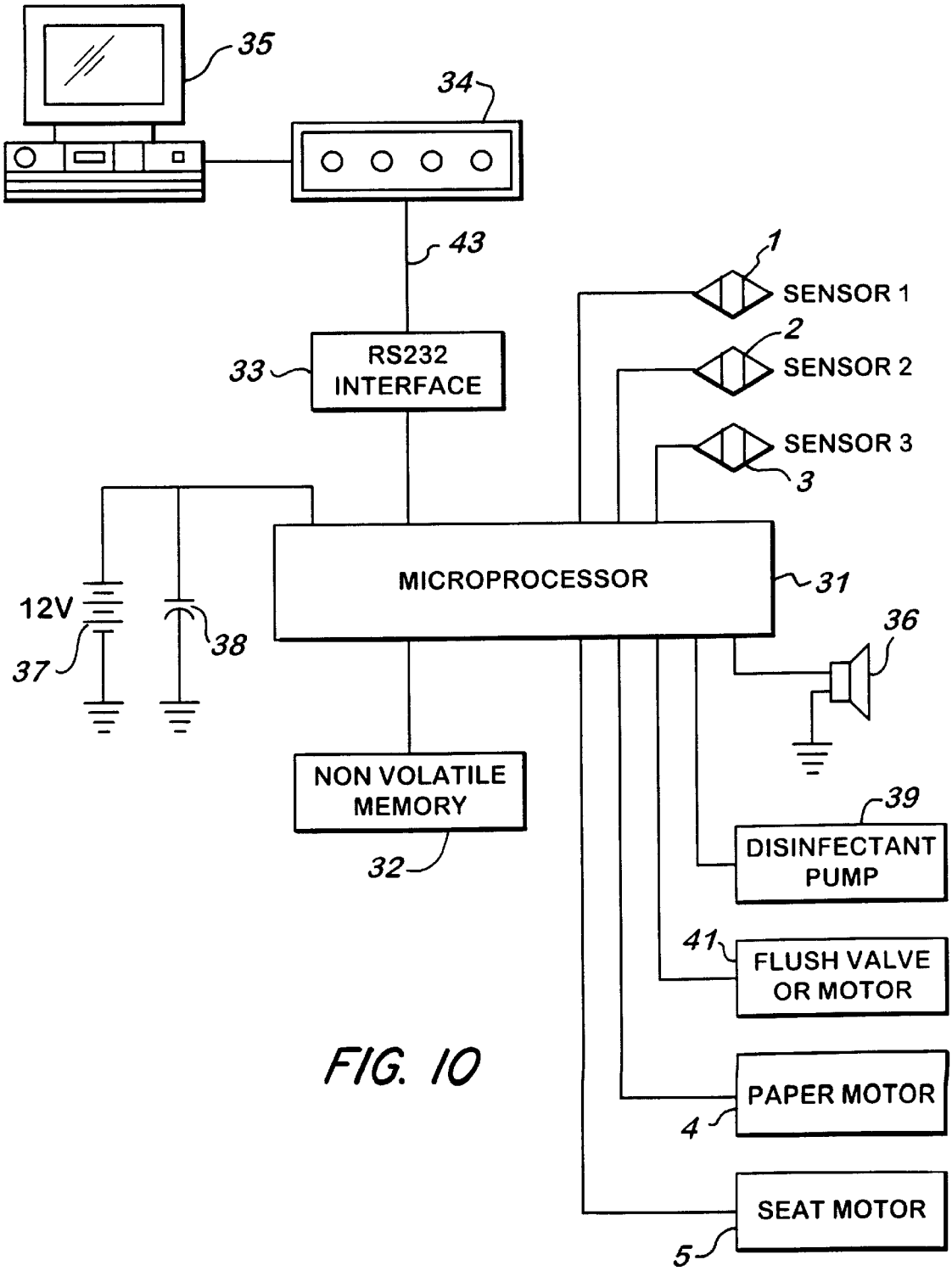
FIG. 10 is a schematic block diagram showing the connections of the microprocessor of the automatic toilet seat of FIG. 1.

A schematic block diagram showing the connections of the microprocessor (31) is shown in FIG. 10. A microprocessor (31) is run by a 12 Volt, 1.5 Amp voltage source (37) which has its voltage smoothed by a capacitor (38). The microprocessor (31) has voltage inputs connected to the three sensors (1,2,3) and an interface (33) which is preferably a RS232 serial interface. The microprocessor (31) has voltage outputs connected disinfectant pump (39), the flush valve or motor (41), the paper motor (4), the seat motor (5), and the buzzer (36). The microprocessor (31) also has both an output and input connected to the digital memory (32) which is preferably non-volatile EEPROM memory.

Still referring to FIG. 10, a computer or terminal using a RS232/V.24 serial link can be used to program the operating parameters of the automatic toilet (40). The computer (35) has a modem (34) connected to the serial interface (33), which is connected to the microprocessor (31). The computer preferably uses the "Hyperterminal" program of the Microsoft WINDOWS '95 operating system. The parameters for the serial link (43) between the computer (35) and the serial interface (33) are preferably 9600 baud, no parity bit, 8 databits, 1 stopbit and no handshake. In the WINDOWS '95 Hyperterminal program, these serial link (43) parameters are specified with the exception that "no flow control" is chosen instead of "no handshake." When the connection between the terminal and a PC is established, it is possible to change the parameters as described below or to report the present values of the parameters.

Figure 7:
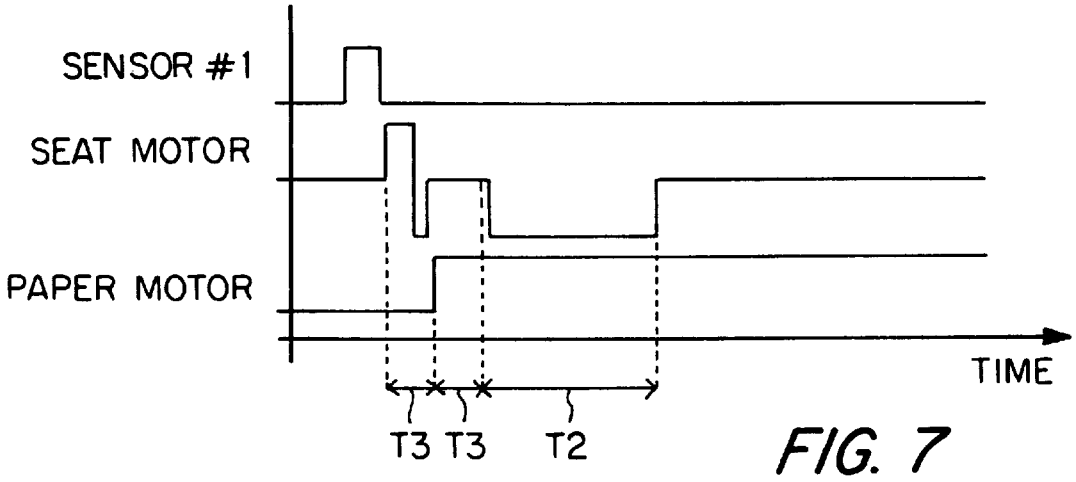
FIG. 7 is a timing diagram that shows the direction of both motors by sensor No. 1.
Figure 8:
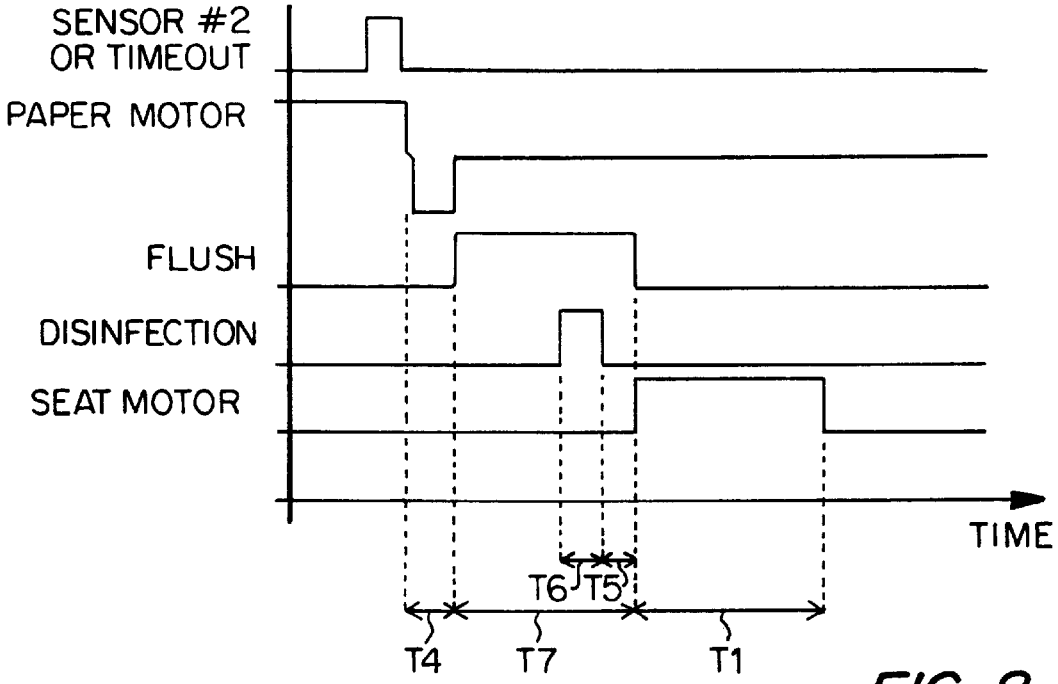
FIG. 8 is a timing diagram that shows the direction of other service units by sensor No. 2.

Parameters T1 through T9 are shown in the timing diagrams of FIGS. 7 and 8. These parameters are stored in a non-volatile memory (EEPROM) (32), so they will be stored even if the power is disconnected. T1 is the time for the seat motor (5) to left the seat and is preferably 2.25 seconds with an adjustable range of zero to 12.75 seconds. T2 is the time for the seat motor (5) to lower the seat (11) and is preferably 2.75 seconds with an adjustable range of zero to 12.75 seconds. T3 is the time for the seat motor (5) to touch the paper (8) and is preferably 0.25 seconds with an adjustable range of zero to 12.75 seconds. T4 is the time for the paper motor (5) to fix or release the paper and is preferably 0.25 seconds with an adjustable range of zero to 12.75 seconds. T5 is the time the disinfection pump (39) starts before the end of the flush and is preferably 0.50 seconds with an adjustable range of zero to 12.75 seconds. T6 is the time the disinfection pump (39) runs to dispense the disinfectant and is preferably 0.25 seconds with an adjustable range of zero to 12.75 seconds. T7 is the time the flush runs for either a flush motor or a flush valve (41). If this value is zero, a potentiometer is preferably used to adjust this time and is preferably 0.50 seconds with an adjustable range of zero to 12.75 seconds. T8 is the time the flush motor must run to operate the flush. Preferably, if this value is zero there is no flush motor but instead a "PRESTO" flush valve; if the value is 255 there is a self-timing flush valve connected. T8 preferably has an adjustable range of zero to 12.75 seconds. T9 is the waiting time after the person walks away from the toilet (40) until the toilet automatically flushes and is preferably 15 seconds with an adjustable range of zero to 4.25 minutes.

Additionally, the time of the reverse motion for the relaxation of the grabber (9) after the lifting of the seat is preferably 0.15 seconds with an adjustable range of zero to 12.75 seconds. The time of reverse motion for the relaxation of the paper (30) during the grabbing of the paper is preferably 0.1 seconds with an adjustable range of zero to 12.75 seconds.

The times for the adjustable parameters are preferably stored in the non-volatile memory (32) as "tics." The internal time-base of the toilet (40) preferably uses a crystal stabilized 20 Hz frequency. If a 20 Hz frequency time-base is used, one "tic" will be equal to 1/20 second or 50 milliseconds.

The programmable processor preferably has two basic modes —an operation mode and a program mode. After power-on the processor (31) is in operation mode; this means if the sensors see anything there will be the corresponding actions by the motors and valves. In other words, in operation mode the toilet runs normally. The program mode will be activated when the processor recognizes any command from the serial interface. In the program mode, the processor will no longer react to the sensors. By command it is preferably possible to monitor the status of the sensors.

It is also possible to adjust the distance at which the sensors (1,2,3) trigger. To return to the operation mode after all settings are done, it is necessary to use another predetermined command.

Thus, a fully automatic process control is achieved, because all electric elements including the sensors in turn can be programmed externally by IR programming or a connected personal computer. The result is a substantially broader, universal application of the automatic toilet seat presented here, and this invention can easily be adapted to diverse construction conditions.

The present invention, therefore, provides a drive mechanism for an automatic toilet seat with a protective cover that can be produced and operated with substantially improved cost effectiveness, simplicity, and safety.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An automatic toilet comprising:

a toilet seat pivotally connected to a toilet bowl;

a pivot motor for automatically raising and lowering said toilet seat;

a plurality of protective coverings;

a covering gripper for gripping said protective coverings and covering said toilet seat with said protective coverings;

a covering-gripping motor for driving said covering gripper;

a plurality of sensors for monitoring conditions around the automatic toilet and generating signals indicative of the monitored conditions; and a microprocessor control for controlling both said pivot motor and said covering-gripping motor based on the signals generated by said sensors.

2. The automatic toilet of claim 1, wherein said pivot motor comprises a direct current motor.

3. The automatic toilet of claim 1, wherein the covering-gripping motor comprises a geared motor.

4. The automatic toilet of claim 1, further comprising an input device for programming said microprocessor.

5. The automatic toilet of claim 4, wherein said input device comprises an infrared input device for wireless programming of said microprocessor.

6. The automatic toilet of claim 4, wherein said input device comprises a computer and a modem.

7. An automatic toilet comprising:

a toilet seat pivotally connected to a toilet bowl;

a direct current pivot motor for automatically raising and lowering said toilet seat;

a plurality of protective coverings;

a covering gripper for gripping said protective coverings and covering said toilet seat with said protective coverings;

a plurality of sensors for monitoring conditions around the automatic toilet and generating signals indicative of the monitored conditions;

a microprocessor control for controlling said pivot motor based on the signals generated by said sensors; and an input device for programming said microprocessor.

8. The automatic toilet of claim 7, further comprising a geared covering gripping motor for driving said covering gripper.

9. The automatic toilet of claim 7, wherein said input device comprises an infrared input device for wireless programming of said microprocessor.

10. In a drive mechanism for an automatic toilet having a seat which can be automatically raised and lowered, a protective covering and a covering gripper for gripping and covering the seat with the protective covering, the improvement comprising a pivot motor for controlling the seat, a covering-gripping motor for driving the covering gripper, and a microprocessor control and a plurality of sensors for controlling both the pivot motor and the covering-gripping motor.

11. The drive mechanism for an automatic toilet of claim 10, wherein the pivot motor for controlling the seat comprises a direct current motor.

12. The drive mechanism for an automatic toilet of claim 10, wherein the covering-gripping motor comprises a geared motor.

13. The drive mechanism for an automatic toilet of claim 10, further comprising an input device for programming the microprocessor.

14. The drive mechanism for an automatic toilet of claim 13, wherein the input device comprises an infrared input device for wireless programming of the microprocessor.

15. An automatic toilet comprising:

a toilet seat pivotally connected to a toilet bowl;

a direct current pivot motor for automatically raising and lowering said toilet seat, said direct current pivot motor slowing a downward pivot action of said toilet seat;

a plurality of protective coverings;

a covering gripper for gripping said protective coverings and covering said toilet seat with said protective coverings; and a plurality of sensors for monitoring conditions around the automatic toilet and generating signals indicative of the monitored conditions.

16. The drive mechanism for an automatic toilet of claim 15, further comprising a microprocessor control for controlling said pivot motor based on the signals generated by said sensors.

17. The drive mechanism for an automatic toilet of claim 15, further comprising an input device for programming said microprocessor.

18. A method for operating an automatic toilet having a toilet seat, a stack of protective sheets with a foremost sheet, a first motor, a second motor and a sensor, the steps comprising:

raising the toilet seat to an upright position against the protective sheets to compress the protective sheets by using the first motor;

grabbing the protective sheets such that a fold is formed in the foremost sheet of the protective sheets by using the second motor;

gripping the fold;

lowering the toilet seat such that the foremost sheet covers the toilet seat;

activating the sensor; and flushing the automatic toilet.

19. The method for operating an automatic toilet having a toilet seat according to claim 18, further comprising the step of controlling both said pivot motor and said covering-gripping motor based on the signals generated by a microprocessor.

20. The method for operating an automatic toilet according to claim 18, wherein the sensor is activated manually by a hand motion.

21. The method for operating an automatic toilet according to claim 18, wherein the sensor is activated automatically.

22. The method for operating an automatic toilet according to claim 21, wherein the sensor is activated automatically by detecting a body presence.

23. The method for operating an automatic toilet according to claim 18, further comprising the step of disinfecting the toilet after flushing the automatic toilet.

24. The method for operating an automatic toilet according to claim 18, further comprising the step of raising the toilet seat after flushing the automatic toilet.

25. The method for operating an automatic toilet according to claim 8, further comprising the step of remotely changing an operating parameter of the automatic toilet.

26. The method for operating an automatic toilet according to claim 25, wherein remotely changing an operating parameter of the automatic toilet is done by using a computer.

27. The method for operating an automatic toilet according to claim 25, wherein remotely changing an operating parameter of the automatic toilet is done by using an infrared input device.

28. The method of operating an automatic toilet according to claim 18, wherein the automatic toilet has a first sensor and further comprising the step of activating the first sensor before raising the toilet seat.

29. A method for operating an automatic toilet having a toilet seat, a stack of protective sheets with a foremost sheet, a motor, and a sensor, the steps comprising:

raising the toilet seat to an upright position against the protective sheets to compress the protective sheets by using the first motor;

grabbing the protective sheets such the toilet seat grips the foremost sheet of the protective sheets;

lowering the toilet seat such that the foremost sheet covers the toilet seat;

activating the sensor;

flushing the automatic toilet; and controlling the steps of raising the toilet seat and grabbing the protective sheets by using a microprocessor.

* * * * *